US006188379B1

(12) United States Patent
Kaneko

(10) Patent No.: US 6,188,379 B1
(45) Date of Patent: Feb. 13, 2001

(54) COLOR DISPLAY SYSTEM AND METHOD OF DRIVING THE SAME

(75) Inventor: Yasushi Kaneko, Sayama (JP)

(73) Assignee: Citizen Watch Co., Ltd., Tokyo (JP)

( * ) Notice: Under 35 U.S.C. 154(b), the term of this patent shall be extended for 0 days.

(21) Appl. No.: 08/964,218

(22) Filed: Nov. 4, 1997

(30) Foreign Application Priority Data

Nov. 5, 1996 (JP) ..... 8-292750

(51) Int. Cl.[7] ..... G09G 3/34

(52) U.S. Cl. ..... 345/102; 345/84; 345/88; 345/89

(58) Field of Search ..... 345/88, 89, 87, 345/102, 84; 348/761, 751

(56) References Cited

U.S. PATENT DOCUMENTS 4,652,087 * 3/1987 Bos et al. ..... 349/34
4,843,381 * 6/1989 Baron ..... 345/88
4,907,862 * 3/1990 Suntola ..... 349/61
5,428,366 * 6/1995 Eichenlaub ..... 345/102
5,621,425 * 4/1997 Hoshino et al. ..... 345/94
5,699,133 * 12/1997 Furuta ..... 349/13

* cited by examiner

*Primary Examiner*—Steven J. Saras
*Assistant Examiner*—Fritz Alphonse
(74) *Attorney, Agent, or Firm*—Armstrong, Westerman, Hattori, McLeland & Naughton

(57) ABSTRACT

A field-sequential type color display system comprises a light source unit composed of a plurality of color light sources which emit light rays of different wavelengths, respectively, and which can be controlled independently of one another, a light source driving circuit for driving the light source unit, a shutter unit for controlling transmittivity of light rays emitted by the light source unit, and a shutter control circuit for controlling the shutter unit in synchronization with the light source driving circuit, wherein a visual field is composed of a plurality of sub-fields corresponding to the plurality of color light sources of the light source unit, and multicolor display is effected by lighting the color light sources for specific colors, respectively, for each of the sub-fields, and by controlling the shutter unit according to the sub-field. The shutter unit comprises a plurality of common electrodes, and the shutter control circuit comprises a circuit for causing a plurality of picture elements to be selectively placed in a display state through multiplexing driving of the common electrodes in response to lighting of the specific color light sources, and a circuit for keeping the shutter unit in a "closed" state by scanning the common electrodes within the sub-fields a plurality of times.

11 Claims, 8 Drawing Sheets

COLOR DISPLAY SYSTEM AND METHOD OF DRIVING THE SAME

BACKGROUND OF THE INVENTION

1. Field of the Invention

The present invention relates to a field-sequential type color display system wherein a visual field is composed of a plurality of sub-fields and images in different color are displayed in each of the sub-fields so that multicolor display is effected by mixing colors while taking advantage of the effect of image synthesis along the time base when viewed by human eyes, and a method of driving the same.

2. Description of the Related Art

One type of field-sequential color display system comprises a display unit for emitting light rays of wavelengths in a wide band, capable of supplying display information by light rays of wavelengths varying for respective sub-fields and a variable filter unit for selecting light rays in specific wavelength regions for the respective sub-fields among the light rays of wavelengths in the wideband. In this arrangement, a high density color CRT has become a reality by a combination of a monochrome CRT with a liquid crystal shutter for changing light into the three primary colors: red, green, and blue.

Another type of field-sequential color display system comprises a light source unit capable of emitting light rays of different wavelengths, and a shutter unit for controlling the light rays emitted by the light source unit on the basis of display information, wherein the light source unit is caused to emit light rays in specific colors for the respective sub-fields while controlling the shutter unit in correspondence thereto.

For a color light source, it is used a fluorescent lamp, or a light emitting diode (LED). In particular, as a result of recent development of LEDs emitting blue light, it has become feasible to fabricate the field-sequential color display system by combining LEDs emitting light in the three primary colors with a monochrome shutter of a simple construction. This type of field-sequential color display system, wherein a low cost shutter is utilized without need for a coloring member such as a color filter or the like, is expected to be put to practical application as a display for audio equipment, measuring instruments and the like.

FIG. 7 shows an example of the field-sequential color display system.

The field-sequential color display system is provided with a light source unit 1 composed of a plurality of color light sources which emit light rays of various wavelengths, and which can be controlled independently of one another. The light source unit 1 comprises an LED box 3, wherein a plurality of light emitting diodes (LEDs) 4 for emitting three colors, red, green, and blue, respectively, are arranged as the color light sources, and a diffuser 5, and it is driven by a light source driving circuit 28.

The field-sequential color display system is provided also with a liquid crystal shutter unit 22, operated by the agency of liquid crystal elements, as a shutter unit for controlling transmittivity of the light rays emitted by the light source unit 1. The liquid crystal shutter unit 22 has display segments 26, capable of displaying characters and numbers, and is controlled by a shutter control circuit 29.

The shutter control circuit 29 is connected with the light source driving circuit 28, and the both circuits are synchronously controlled so as to be driven in synchronization with each other.

FIG. 8 is a block diagram of the field-sequential color display system.

The light source unit 1 consists of a red light source R, a green light source G, and a blue light source B, which are lit up by a red light source signal Lr, a green light source signal Lg, and a blue light source signal Lb, respectively, supplied from the light source driving circuit 28.

The liquid crystal shutter unit 22 comprises a plurality of data electrodes 20 and a common electrode 21, and is statically driven by data signals D and a common signal C delivered from the shutter control circuit 29.

FIG. 9 is a waveform chart showing waveforms of respective signals for driving the field-sequential color display system shown in FIGS. 7 and 8, and the optical response characteristic of the liquid crystal shutter unit 22 at a driving voltage of 20V. In this example, for driving the liquid crystal shutter unit 22 by AC power, two fields, f1 and f2, are in use and each of the fields consists of three sub-fields, fR, fG, and fB.

The red light source signal Lr turns on only in the sub-field fR, while turning off in the other sub-fields fG and fB. Similarly, the green light source signal Lg turns on only in the sub-field fG while turning off in the other sub-fields fB and fR. The blue light source signal Lb turns on only in the sub-field fB while turning off in the other sub-fields fR and fG.

The voltage of the common signal C supplied to the liquid crystal shutter unit 22 becomes c1 in the field f1 and c2 in the field f2. In this case, c1 is set at 20V and c2 is set at 0V. The data signals are at either of two voltages, d1 and d2, and, in this instance, it is assumed that d1 is 20V and d2 is 0V.

In the case of adopting an STN liquid crystal panel in normally white display mode for the liquid crystal shutter unit 22, a data signal Dw for displaying white state is in phase with the common signal C, and as the liquid crystals are not supplied with a voltage, the liquid crystal shutter unit 22 is turned into the OFF state. Meanwhile, a data signal Dbl for displaying black state is in opposite phase with respect to the common signal C, and as the liquid crystals are impressed with a driving voltage equivalent to a difference in voltage between the common signal C and the data signal Dbl, the liquid crystal shutter unit 22 is turned into the ON state.

A data signal for displaying one of the primary colors is at a voltage such that the shutter is in the transmitting (open) state only in one of the sub-fields corresponding to the color. For example, a data signal Dr for displaying red color is at a voltage such that the shutter is in the transmitting state only in the sub-fields fR corresponding to red color while it is in the nontransmitting (closed) state in the sub-fields fG and fB.

A data signal Dg for displaying green color is at a voltage such that the shutter is in the transmitting state only in the sub-fields fG corresponding to green color, and a data signal Db for displaying blue color is at a voltage such that the shutter is in the transmitting state only in the sub-fields fB corresponding to blue color.

In the case that the LED box 3 is adopted for the light source unit 1, the emission characteristics of the red light source signal Lr, green light source signal Lg, and blue light source signal Lb can be regarded the same as those of respective LEDs since the response time of the respective LEDs, which are semiconductors, is very fast.

The span of the field f1 is preferably set to not more than 20 ms for obtaining good mixing of colors without causing a viewer to recognize flicker, and accordingly, the span of the sub-fields, fR, fG, and fB, respectively, is set to 5 to 6 ms.

A change from the "closed" to the "open" state of the optical response characteristic Tr of the liquid crystal shutter unit 22 for displaying red is delayed with respect to the data signal Dr for displaying red color by 1.5 to 3.0 ms, equivalent to an OFF response time of the liquid crystal panel. Consequently, the amount of light rays emitted from the red light source is slightly decreased. Similarly, the optical response characteristic Tg for displaying green switches to the "open" state behind the data signal Dg for displaying green color by 1.5 to 3.0 ms, and the optical response characteristic Tb for displaying blue switches to the "open" state behind the data signal Db for displaying blue color by 1.5 to 3.0 ms.

However, since the response time of the liquid crystal panel switching from the "open" to the "closed" state is as fast as 0.1 to 1.0 ms at the driving voltage of 20V or more (depending on the applied voltage), the optical response characteristic Tr when displaying red is completely in the "closed" state in the sub-field fG, with the result that display in red with good chroma is obtained without any mixing of colors caused by the green light source.

Similarly, the optical response characteristic Tg when displaying green, and the optical response characteristic Tb when displaying blue, will cause no mixing of colors caused by the blue and red light sources, respectively, displaying respective colors with high chroma.

Data signals for displaying a plurality or mixture of the primary colors are at a voltage, respectively, such that the shutter is in the transmitting (open) state only in the sub-field corresponding to respective color.

For example, a data signal for displaying bluish green is at a voltage such that the shutters are in the transmitting state in the sub-fields fG and fB, corresponding to green and blue, respectively, while the shutter is in the "closed" state in the sub-field fR. A data signal for displaying purple is at a voltage such that the shutters are in the transmitting state in the sub-fields fB and fR, corresponding to blue and red, respectively. A data signal for displaying yellow is at a voltage such that the shutters are in the transmitting state in the sub-fields fR and fG, corresponding to red and green, respectively.

The conventional field-sequential type color display system of a simple arrangement as described hereinbefore is capable of effecting multicolored display, and can be provided at low cost since a coloring member such as a color filter or the like is not required therein.

However, with the conventional field-sequential color display system using STN (super-twisted nematic) liquid crystal panels in the liquid crystal shutter unit 22, numbers and characters can be displayed by means of eight display segments, but it is difficult to display any character or graphic in dots. The reasons why are described hereinafter.

To achieve display of any character or graphic by means of dot display, the number of display segments needs to be increased through multiplexing driving by use of plural common electrodes.

With an ordinary STN liquid crystal display system, multiplexing driving for performing ON/OFF display by slightly varying effective voltages applied to the respective display segments can be effected by means of a driving method called the voltage averaging method, using the plurality of common electrodes. However, response times in such a case become as long as a hundred to several hundreds of ms due to minimal differences between applied voltages. Hence, it is difficult to adopt the STN liquid crystal panel for the liquid crystal shutter unit of the field-sequential type color display system for displaying any character or graphic by means of dot display.

Then, it is conceivable to use a liquid crystal panel composed of ferroelectric liquid crystals or antiferroelectric liquid crystals, having a memory property, for the liquid crystal shutter unit 22. In this case, for multiplexing driving, it is necessary to divide the span of respective sub-fields into two parts, that is, a writing period of 1 to 2 ms, and a holding period of 4 to 5 ms, and to hold a display state after scanning once with the common electrode while lighting the light source unit during the holding period.

However, the liquid crystal panel composed of ferroelectric liquid crystals or antiferroelectric liquid crystals is not widely used because the gap between liquid crystal cells thereof needs to be controlled to not more than 2 $\mu$m, and there is a technical problem of uniformly aligning smectic phase liquid crystals in jelly form, both factors serving to increase the cost.

SUMMARY OF THE INVENTION

It is an object of the present invention to provide a low-cost field-sequential type color display system capable of responding at high speed through multiplexing driving, and of displaying arbitrarily colored characters and graphics with a dot display system having many display segments, and a method of driving the same.

The field-sequential type color display of the present invention comprises a light source unit composed of a plurality of color light sources which emit light rays of different wavelengths, respectively, which can be controlled independently of one another, a light source driving circuit for driving the light source unit, a shutter unit for controlling transmittivity of light rays emitted by the light source unit, and a shutter control circuit for controlling the shutter unit in synchronization with the light source driving circuit.

In the field-sequential type color display system described above, a visual field is composed of a plurality of sub-fields corresponding to the plurality of color light sources of the light source unit, and multicolor display is effected by lighting the color light sources for specific colors, respectively, for each of the sub-fields, and by controlling the shutter unit according to the sub-field. It is structured as follows to achieve the above object.

That is, a plurality of common electrodes are provided in the shutter unit, and means for causing a plurality of picture elements to be selectively placed in a display state through multiplexing driving of the common electrodes by the shutter control circuit in response to lighting of the specific color light sources, and means for keeping the shutter unit in the "closed" state by scanning the common electrodes within the sub-fields a plurality of times are provided in the stutter control circuit.

Further, means for keeping the shutter unit in the transmitting state by providing a white reset period additionally within the sub-fields, respectively, may be provided in the shutter control circuit.

In the field-sequential type color display system, the shutter unit may be an STN liquid crystal panel composed of twisted angle through 180 to 270°, the product $\Delta nd$ of a birefringence $\Delta n$ of the liquid crystal materials and a cell gap d being in the range of 650 to 850 nm.

Still further, the present invention provides a method of driving the field-sequential type color display system, comprising steps of causing a plurality of picture elements to be selectively placed in a display state through multiplexing driving of the plurality of common electrodes provided in the shutter unit by the shutter control circuit in response to lighting of the color light sources of the light source unit for specific colors by the light source driving circuit, and scanning the common electrodes within the sub-fields a plurality of times for keeping the shutter unit in the "closed" state.

In the method of driving the field-sequential type color display system, when keeping the shutter unit in the "open" state, a white reset period may be provided within the respective sub-fields.

When causing the plurality of picture elements to be selectively placed in a display state through multiplexing driving of the plurality of common electrodes provided in the shutter unit, common signals are applied to the common electrodes while data signals are applied to data electrodes crossing at right angles with the common electrodes, and a ratio of a voltage applied by the common signals to that applied by the data signals may be set to about 2:1.

Further, when keeping the shutter unit in the "closed" state, the span of the respective sub-fields is set to 4 to 6 ms, and the common electrodes are scanned from 6 to 15 times in the respective sub-fields.

The above and other objects, features and advantages of the invention will be apparent from the following detailed description which is to be read in conjunction with the accompanying drawings.

DESCRIPTION OF THE PREFERRED EMBODIMENTS

A field-sequential type color display system according to a preferred embodiment of the invention will be now described with reference to the attached drawings.

First of all, the construction of the field-sequential type color display system will be described with reference to FIGS. 1 and 2.

Figure 7:
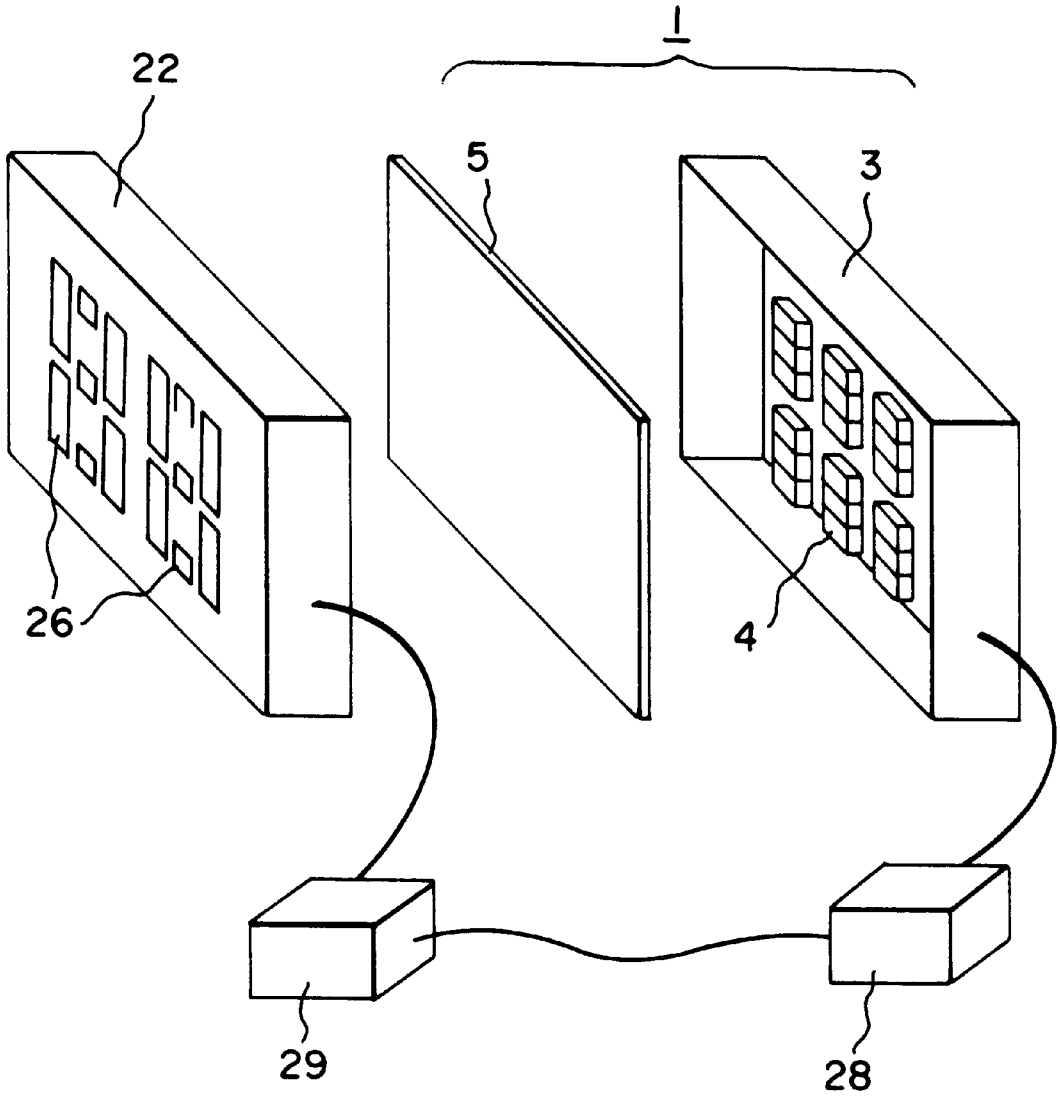
FIG. 7 PRIOR ART
FIG. 7 and FIG. 8 are a perspective view and a block diagram showing a construction of a conventional field-sequential type color display system.
Figure 8:
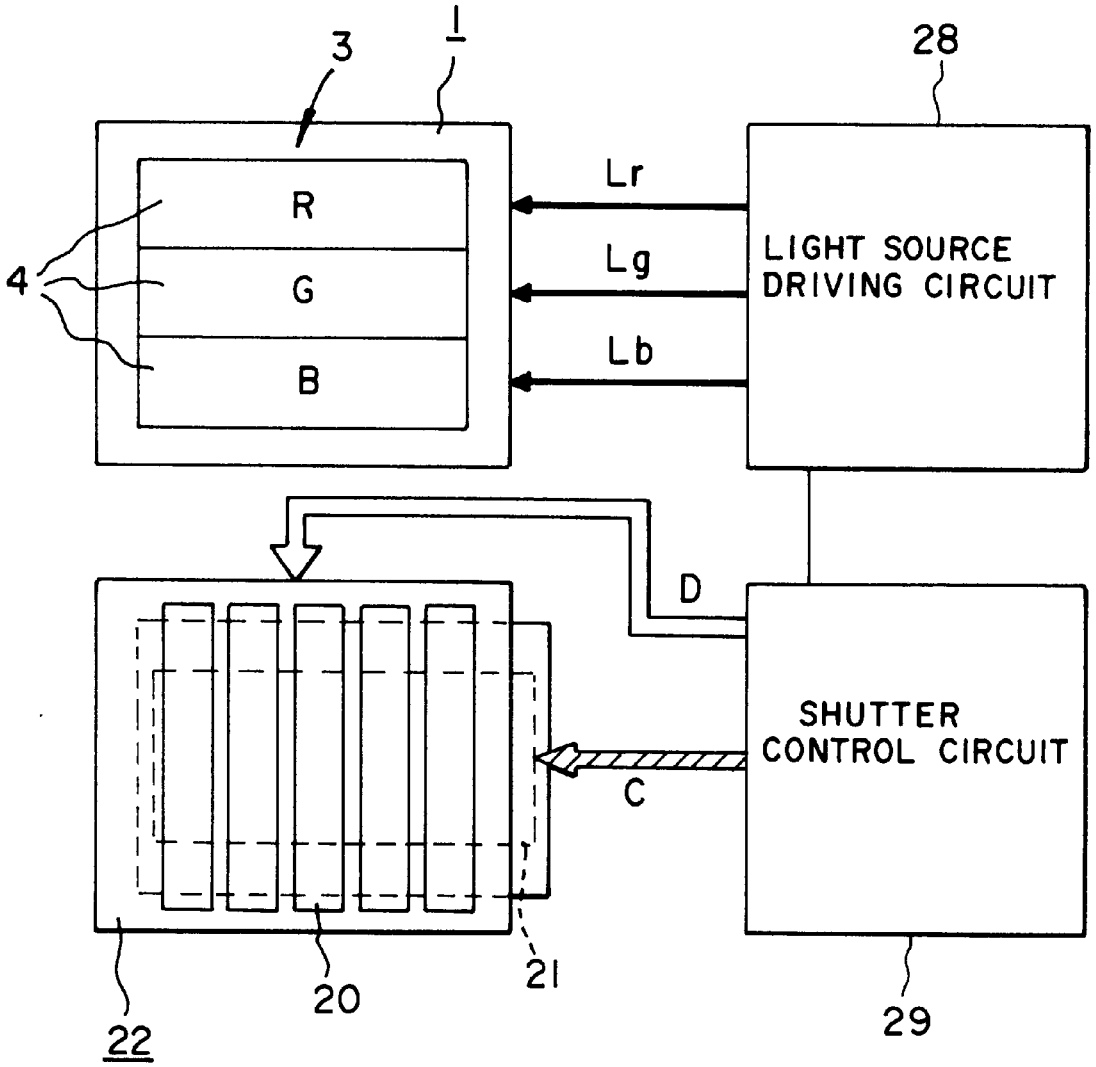
FIG. 8 PRIOR ART
Figure 9:
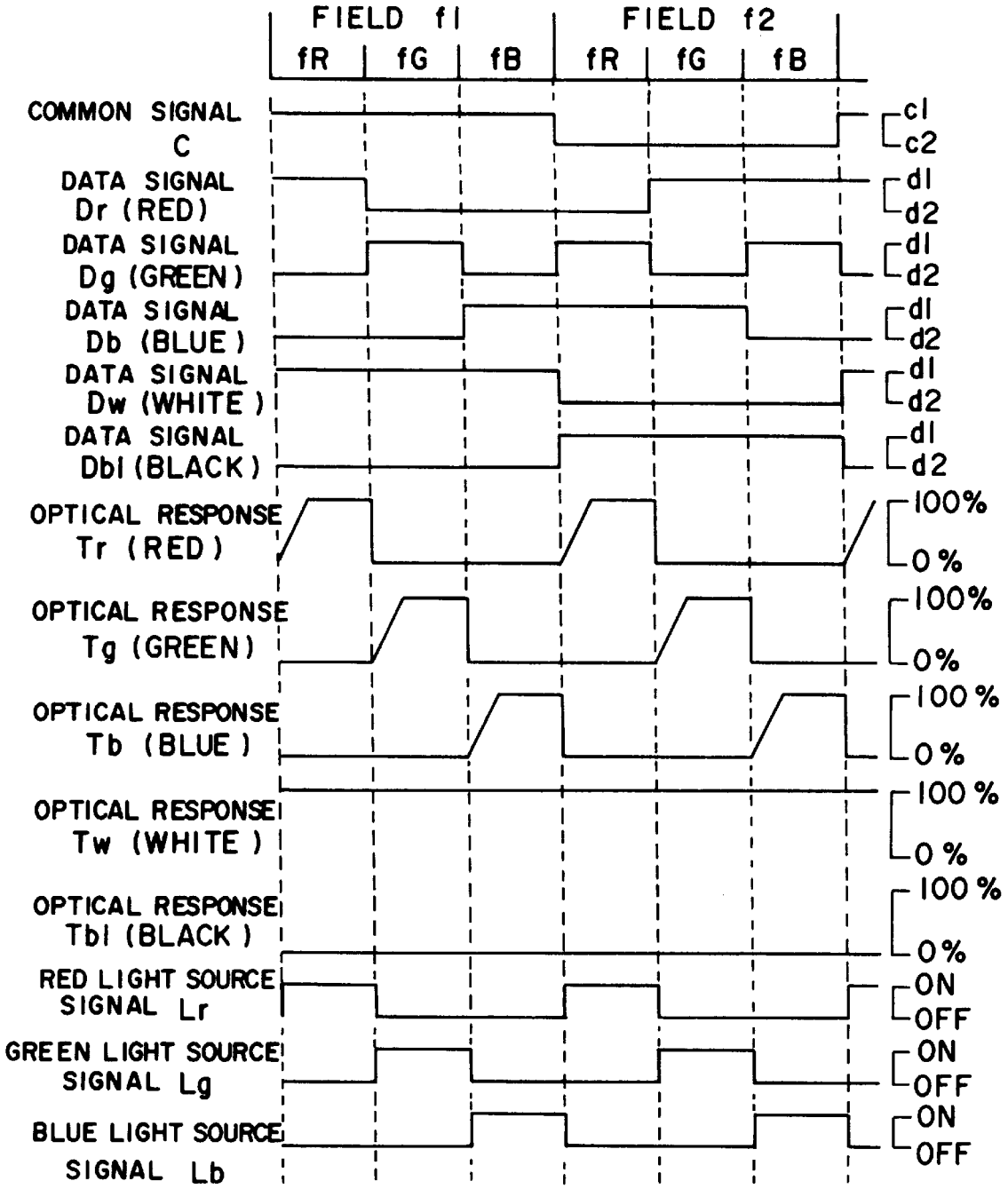
FIG. 9 PRIOR ART
FIG. 9 is a waveform chart showing waveforms of respective signals applied to a light source unit and a shutter unit and optical response characteristic of the shutter unit for explaining a method of driving the conventional field-sequential type color display system show n in FIGS. 7 and 8.

The color display system comprises a light source unit 1, a liquid crystal shutter unit 2, a light source driving circuit 8 for driving the light source unit 1 and a shutter control circuit 9 for controlling the liquid crystal shutter unit 2. The basic constructions of these components of the color display system are substantially the same as those of the field-sequential type color display system as explained with reference to FIGS. 7 and 8.

The light source unit 1 comprises an LED box 3, wherein LEDs 4 for three colors, red, green, and blue, respectively are arranged as the color light sources, and a diffuser 5. And the light source unit 1 is drived by the light source driving circuit 8.

However the liquid crystal shutter unit 2 for controlling light rays emitted by the light source unit 1 has display segments 6 which are capable of displaying arbitrary characters, numerals and graphics. The number of display segments 6 of the liquid crystal shutter unit 2 is several times larger than that of the conventional one and the display segments can display arbitrary characters and graphics with dot display.

The liquid crystal shutter unit 2 is controlled by a control circuit 9. The light source driving circuit 8 and the control circuit 9 are connected to each other and are driven in synchronization with each other.

Figure 2:
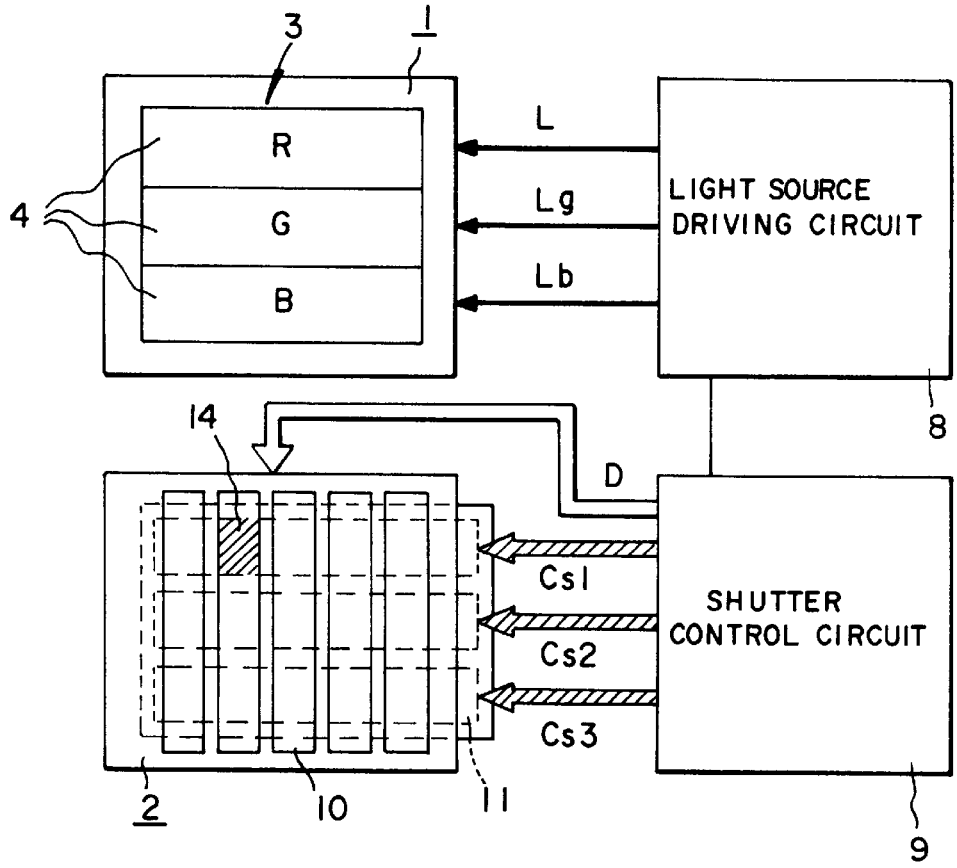

The light source unit 1 of the color display system comprises a red light source R, a green light source G and blue light source B as shown in FIG. 2, and they are energized by a red light source signal Lr, a green light source signal Lg and a blue light source signal Lb, which are supplied from the light source driving circuit 8.

Meanwhile, the liquid crystal shutter unit 2 includes a plurality of data electrodes 10 and a plurality of common electrodes 11 and they are subjected to multiplexing driving by a data signal D and common signals Cs1 to Cs3 which are supplied from the control circuit 9. In this embodiment, there are three common electrodes 11.

The liquid crystal shutter unit 2 is an STN liquid crystal panel, and there is one type of STN liquid crystal panel which is normally black mode, i.e. a "closed" state, when an OFF voltage is applied, and there is another type which is normally white mode, i.e. an "open" state, when an OFF voltage is applied, and any one of type may be used for the liquid crystal shutter unit 2. However, the STN liquid crystal panel normally in white display mode is used for the liquid crystal shutter unit 2 in the present embodiment. Accordingly, the liquid crystal shutter unit 2 is in the "open" state, i.e. in a light transmitting state, when the OFF voltage is applied, and in the "closed" state, i.e. in the light interception state, when the ON voltage is applied.

Although the STN liquid crystal panel may be composed of twisted angle through 180 to 270°, so as to make the response time fast, the liquid crystals are preferably to be twisted as much as possible, and are set to be twisted through 240° considering the fabrication thereof in the present embodiment.

An STN liquid crystal panel having a product $\Delta nd$ in the range of 650 to 850 nm shows good performance, where d is the thickness of the liquid crystal layer, i.e. a cell gap, and $\Delta n$ is the birefringence rate of the liquid crystals, but in the present embodiment the product $\Delta nd$ is set to 750 nm considering the background color and the brightness of the display segments.

Polarized axis of polarizing films which are disposed outside of an STN liquid crystal panel are arranged at an angle of about 45° relative to the liquid crystal molecules positioned in the center of the upper and lower glass substrates. That is, the upper polarizing film is disposed at an angle of +45° and the lower polarizing film is disposed at an angle of −45° relative to the priority of the liquid crystal panel and the crossing angle of the upper and lower polarizing films is about 90°. However the crossing angle between the polarization films may be varied in the range of 80 to 100° to adjust the background color.

Figure 3:
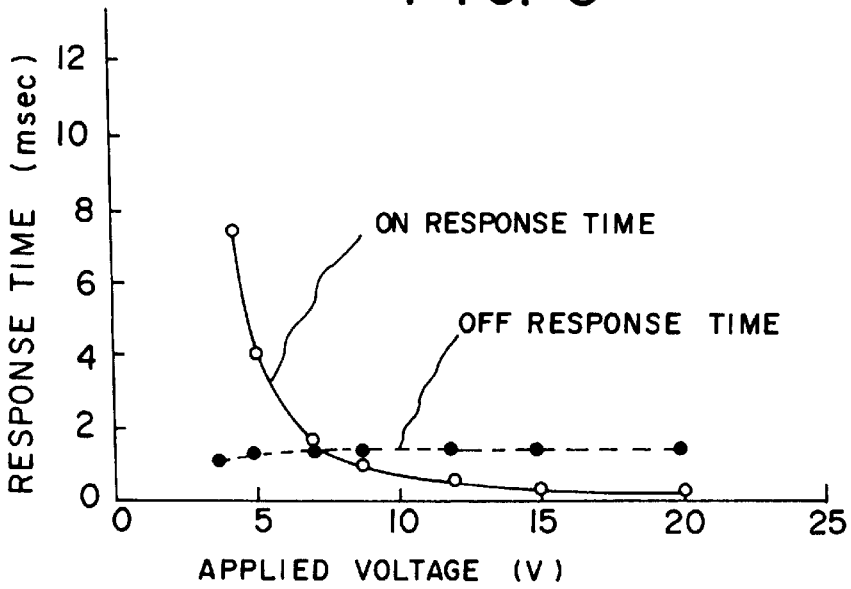
FIG. 3 is a graph showing the relation between response time of the liquid crystal shutter and the applied voltage dependency characteristic.

The relation between the response time of the STN liquid crystal panel adopted for the liquid crystal shutter unit 2 and the applied voltage is shown in FIG. 3. In FIG. 3, the solid line shows the response time from the "open" to the "closed" state at room temperature and dotted line shows the response time from the "closed" state to the "open" state at the time when the driving voltage is returned to 0V.

The ON response time is varied depending on the applied voltage, and it is 1 ms at a driving voltage of 9V, and 0.5 ms at a driving voltage of 12V, which is faster than at the driving voltage of 9V, but it is about 8 ms at a driving voltage of 4V which is very much slower than that at the voltages of 9V and 12V.

Meanwhile, the OFF response time from the "closed" to the "open" state is a return to the state where no voltage is applied, and it is substantially determined by cell conditions, such as the type of liquid crystal material, the thickness of the liquid crystal panel, and the twisted angle, and it is not very dependent on the applied voltage, as shown in the dotted line in FIG. 3.

The STN liquid crystal panel adopted in the present embodiment is optimized to reduce the OFF response time, which is 2 ms or less at room temperature.

Accordingly, if the voltage of the selected waveform is 9V or more when it is turned on through the multiplexing driving and is 4V or less when it is turned off, the multiplexing driving can be performed while maintaining the high speed response characteristic utilizing the difference of voltage therebetween.

Figure 4:
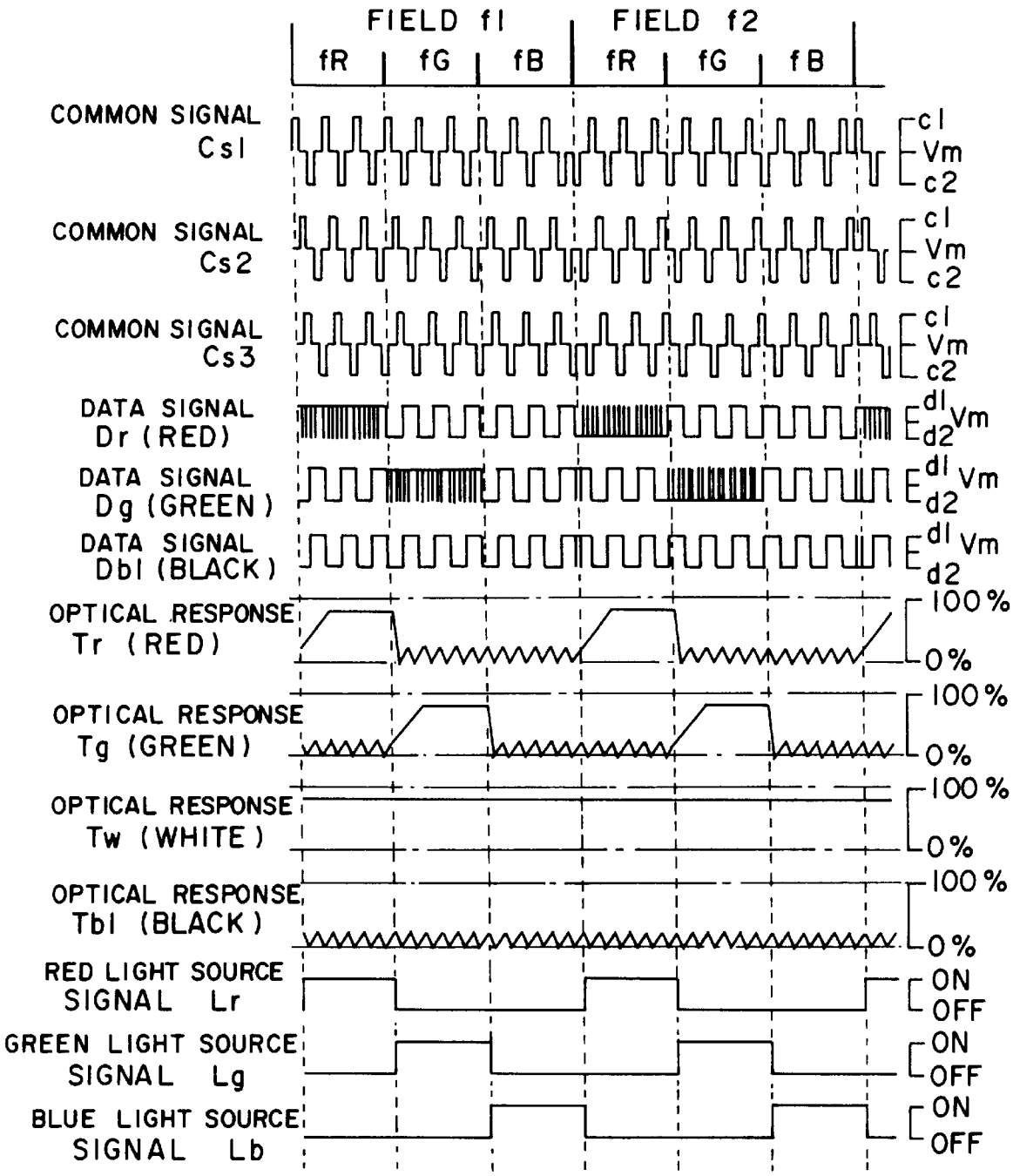
FIG. 4 is a waveform chart showing waveforms of respective signals applied to a light source unit and a shutter unit and optical response characteristic of the shutter unit for explaining a method of driving the field-sequential type color display system of the invention.

Fig. 4 is a waveform chart showing waveforms of respective signals and optical response characteristic of the shutter unit 2 for explaining a method of driving the field-sequential type color display system of the invention. FIG. 4 is a case where the common electrodes 11 are scanned six times in the respective sub-fields.

Each sub-field comprises two fields f1 and f2 for driving the liquid crystal shutter unit 2 by AC power, and each of the fields consists of three sub-fields: fR, fG, and fB similar to the prior art.

It is preferable that the span of each of field f1 and f2 is set for 20 ms or less to obtain excellent mixing of colors without causing a viewer to recognize flicker, and it is set to 18 ms in this embodiment. Accordingly, the sub-fields fR, fG and fB are set to 6 ms.

The red light source signal Lr turns on for the duration of the sub-field fR and it turns off in the other sub-fields fG and fB. Likewise, the green light source signal Lg turns on for the duration of the sub-field fG and turns off in the other sub-fields fB and fR. The blue light source signal Lb turns on for the duration of the sub-field fB and it turns off in the other sub-fields fR and fG.

As response times of the LEDs, which are semiconductors, are very fast, the light emission characteristics of the red light source signal Lr, green light source signal Lg, and blue light source signal Lb are regarded the same as that of the respective LEDs in the case where the LED box 3 is adopted for the light source unit 1.

The common signals Cs1 to Cs3 to be supplied to the liquid crystal shutter unit 2 will be at three different voltages, that is, a select voltage c1, unselect voltage Vm, and select voltage c2, which is equivalent to the select voltage c1 in absolute value, but at the polarity opposite to that of the select voltage c1. The data signal D will be at an ON voltage d2 and an OFF voltage d1 with the common signals at c1, and will be at a reversed ON voltage d1 and OFF voltage d2 with the common signals at c2.

Meanwhile, a data signal D for displaying one of the primary colors has a waveform such that the shutter is in the transmitting (open) state only in one of the sub-fields corresponding to the color. For example, a data signal Dr for displaying red color has a waveform such that the shutter is in the transmitting state only in the sub-fields fR corresponding to red color while it is in the nontransmitting state in the sub-fields fG and fB. A data signal Dg for displaying green color has a waveform such that the shutter is in the transmitting state only in the sub-field fG.

Data signals for displaying a plurality of primary colors have waveforms, respectively, such that the shutter is in the transmitting state only in the sub-fields corresponding to each color. For example, a data signal for displaying bluish green is at a voltage such that the shutter is in the transmitting state in the sub-fields fG and fB, corresponding to green and blue, respectively, while it is in the "closed" state in the sub-field fR. A data signal for displaying purple has a waveform such that the shutter is in the transmitting state in the sub-fields fB and fR, corresponding to blue and red, respectively. A data signal for displaying yellow has a voltage such that the shutter is in the transmitting state in the sub-fields fR and fG, corresponding to red and green, respectively.

Figure 5:
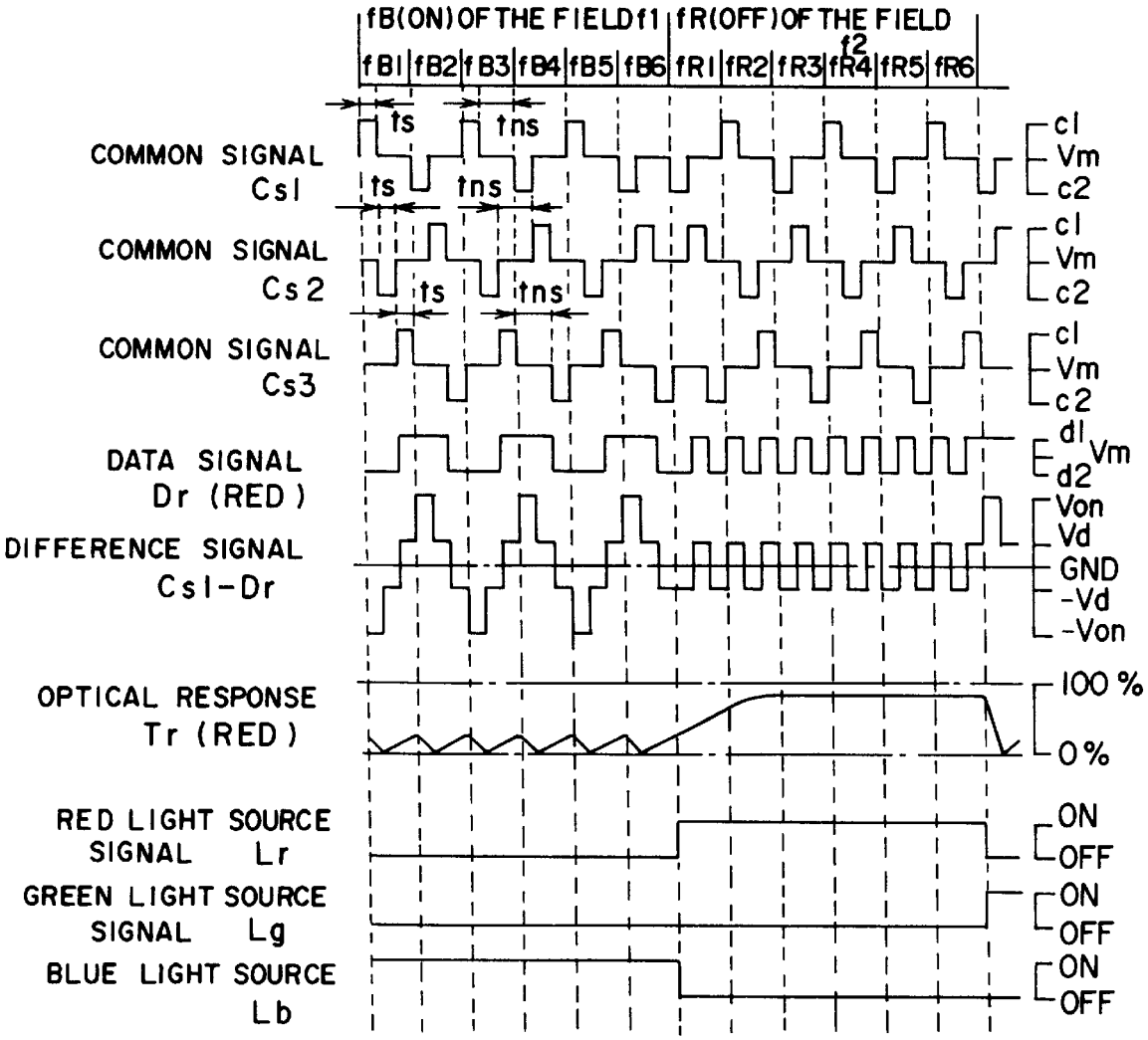
FIG. 5 is a partially enlarged view of a waveform chart showing waveforms of respective signals applied to the light source unit and the shutter unit and an optical response characteristic of the shutter unit shown in FIG. 4.

FIG. 5 is a view enlarging the sub-filed fB of the field f1, and the sub-field fR of the field f2 shown in FIG. 4, and also showing detailed waveforms of respective signals and an optical response characteristic of the shutter unit.

In the order presented from the top thereof in FIG. 5, common signals Cs1 to Cs3, a data signal Dr applied to the data electrode 10 corresponding to the red picture element 14 for displaying red as shown in FIG. 2, a differential signal Cs1−Dr, representing a difference between the common signal Cs1 and the data signal Dr, that is, a signal actually applied to the red picture element 14, the optical response characteristic Tr of the red picture element 14 for displaying red, and light source driving signals Lr, Lg and Lb are shown.

The sub-field is composed of six scanning frames fB1 to fB6 for scanning the common electrodes 11 within the sub-field fB six times. Since the span of the sub-field is set to 6 ms in this embodiment, each scanning frame is 1 ms.

The respective scanning frames consist of a select period ts for applying the select voltage c1 or the select voltage c2 of the common signals Cs1, and an unselect period tns for applying the unselect voltage Vm, and the polarity of the select voltage is reversed from one scanning frame to another such as at c1 in fB1, at c2 in fB2, and so on. Further, polarities of voltages in the field f2 are opposite to those in the field f1, such as the select voltage at c2 in fR1, the select voltage at c1 in fR2, and so on.

In this embodiment, the polarities of the select voltage of the common signals in the field f1 are reversed from those in the field f2. However, there will arise no problem without phase inversion in the field f2 since AC power has already been applied to the field f1. Further, even if all the select voltages of the field f1 are set at c1 and all the select voltages of the field f2 are set at c2, no problem arises whatsoever.

A common voltage Vc which is a voltage applied by the common signal Cs1 is defined as Vc=c1−Vm=Vm−c2, and a data voltage Vd which is a voltage applied by the data signal is defined as Vd=d1−Vm=Vm−d2. In this embodiment, the common voltage Vc is set to twice the value of the data voltage Vd. That is, the so-called bias ratio (Vc+Vd)/Vd=3.

Accordingly, if the data signal at the ON voltage d2 is applied during theselect period ts when the select voltage c1 is applied to the common electrodes 11, a voltage Vc+Vd=3×Vd is applied to the picture element while a voltage Vc−Vd=Vd is applied to the picture element when the data signal at the OFF voltage d1 is applied. During the unselect period tns when the unselect voltage Vm is applied to the common electrodes 11, the voltage Vd is applied to the picture element since the data voltage is either Vd or −Vd.

Although the field sequential color display system could be driven at a bias ratio in the range of 2 to 5 in the case of Vc+Vd=9V, the OFF voltage during the select period ts becomes the same as the voltage during the unselect period tns, and Vd=3V in the case of the bias ratio being 3, eliminating variation in transmittivity as the differential signal Cs1−Dr in the sub-fields fR of the fields 2, resulting in obtaining a maximum transmittivity of about 80%.

Meanwhile, the picture element 14 needs to be in black display for the span of the sub-fields fB of the field f1. During the select period ts of the scanning frame fB1, an ON voltage, −Von=3×Vd=9V is applied as the differential voltage Cs1−Dr, and hence the response time becomes as fast as 1 ms or lower, turning the display to black for nearly 0% transmittivity. However, during the unselect period tns, the differential signal Cs1−Dr is reduced to −Vd, causing transmittivity to gradually revert to a higher level.

However, the select period ts of the scanning frame fB2 arrives immediately after, and a voltage Von as the differential signal is applied thereto, turning display to black again for transmittivity as low as 0%. This is repeated six times in the sub-field fB, so that the average transmittivity of the sub-field fB becomes about 8%, enabling the liquid crystal shutter unit 2 to have a contrast ratio of about 10 and to display excellent color.

In the case that the respective scanning frames of sub-frame fB consist of scanning one time in fB1 only and the equibvalent span of other succeeding fB2 to fB6 are kept in pause condition, even if display in black is attained during the selective period ts, display in black is not maintained for the span of the unselect period tns and the pause period. Because of the lack of memory function of the STN liquid crystals, transmittivity is caused to revert to a higher level during the respective span.

In the case that the span of the sub-field fB is divided into three parts, i.e. the select period ts and the unselect period tns (nearly equivalent to 2×ts), the unselect period tns becomes about 4 ms so that the transmittivity is caused to revert to a higher level, and hence display in black is not attained enough. On the other hand, if the number of times that the respective sub-fields are scanned is excessive, the select period ts for applying the ON voltage Von becomes too short, and display in full black can not be attained, so that the number of scanning times is preferably on the order of from 4 to 20. In particular, the best results were obtained at the number of scanning times of from 6 to 15.

As described hereinbefore, according to a field-sequential type color display system and a method of driving the same, since the multiplexing driving is performed by use of a plurality of common electrodes even in the case where the STN liquid crystal panel is adopted for the liquid crystal shutter unit, dot display can be effected by increasing the number of display segments, and hence it has become possible to provide a low-cost color display system capable of displaying arbitrary characters and graphics.

Although the data signals D shown in FIG. 5 always take only the voltage of d1 or d2 in each sub-field according to the present embodiment, they can take an intermediate value on the voltage axis or time axis to display multicolors other than the primary colors. The case where the voltage axis has multiple values corresponds to amplitude modulation and the case where the time axis has multiple values corresponds to pulse width modulation. Accordingly, the color display system can display many colors corresponding to intermediate colors if a single primary color, plural primary colors, and driving waveforms are devised.

Although it was explained in the embodiment as described hereinbefore that the LEDs 4 for the three different colors, i.e. red, green, and blue, were adopted for the light source unit 1, if LEDs for only two colors are adopted, display in white is not attained and the number of emitted light rays in specific colors is reduced, but it is evident that the latter case has the same effect as the former case in other respects.

Further, it is not necessary that the spans of the sub-fields, fR, fG and fB all be the same, and if the period of any sub-field is changed, the display in color or display in the background color can be adjusted.

Although it was explained in this embodiment that three common electrodes are provided, it is needless to say that four common electrodes may be provided, and also there may be provided 10 common electrodes or more depending on the condition of the STN liquid crystal panels.

Figure 6:
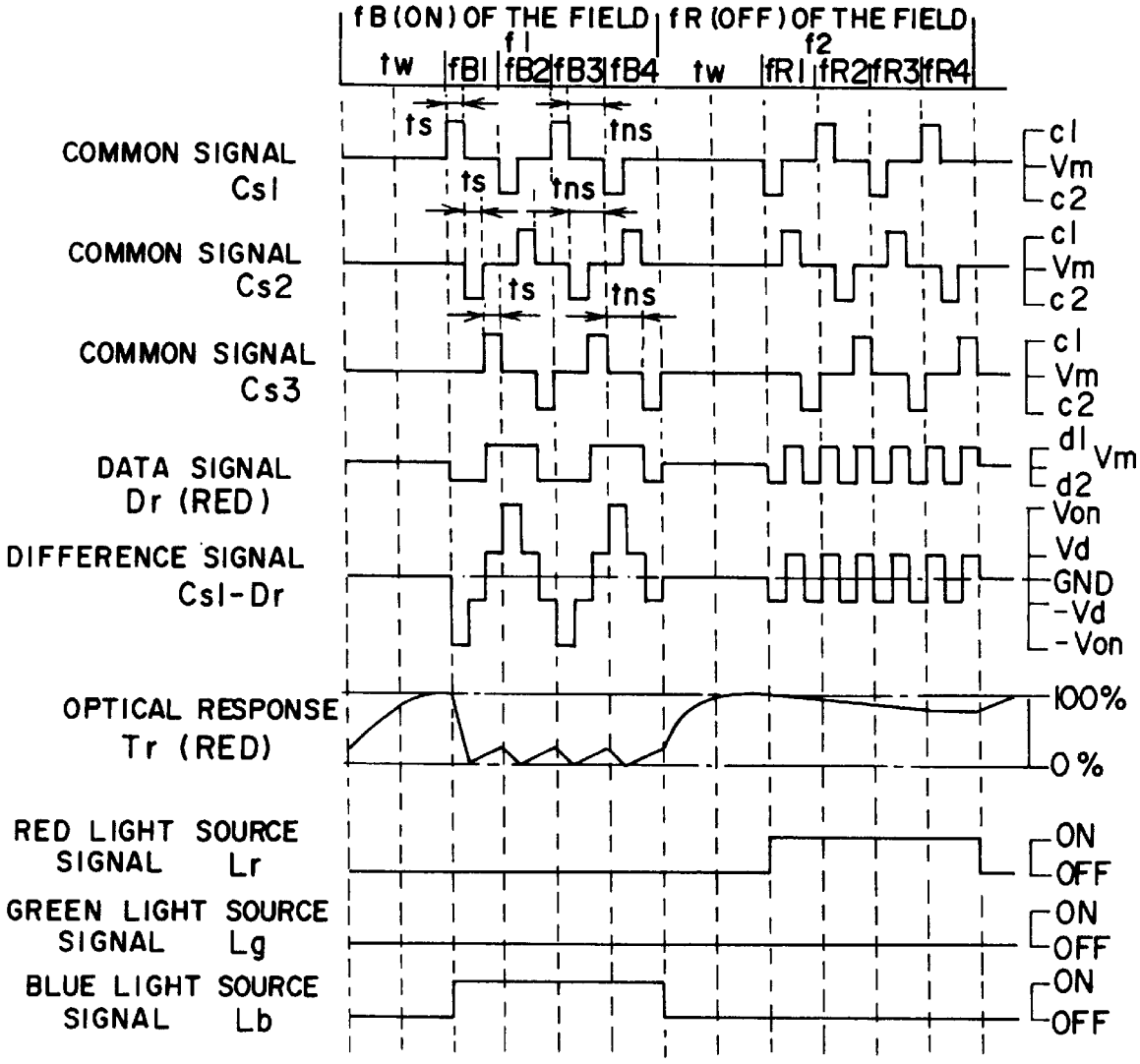
FIG. 6 is partially enlarged view of a waveform chart showing waveforms of respective signals applied to the light source unit and the shutter unit and an optical response characteristic of the shutter unit for explaining another method of driving the field-sequential type color display system of the invention similar to FIG. 5.

A method of driving the field sequential type color display system of the invention according to another embodiment will now be described with reference to FIG. 6. FIG. 6 is a partially enlarged view of a waveform chart showing waveforms of respective signals applied to the light source unit and the shutter unit and showing the optical response characteristic of the shutter unit, similar to FIG. 5.

Figure 1:
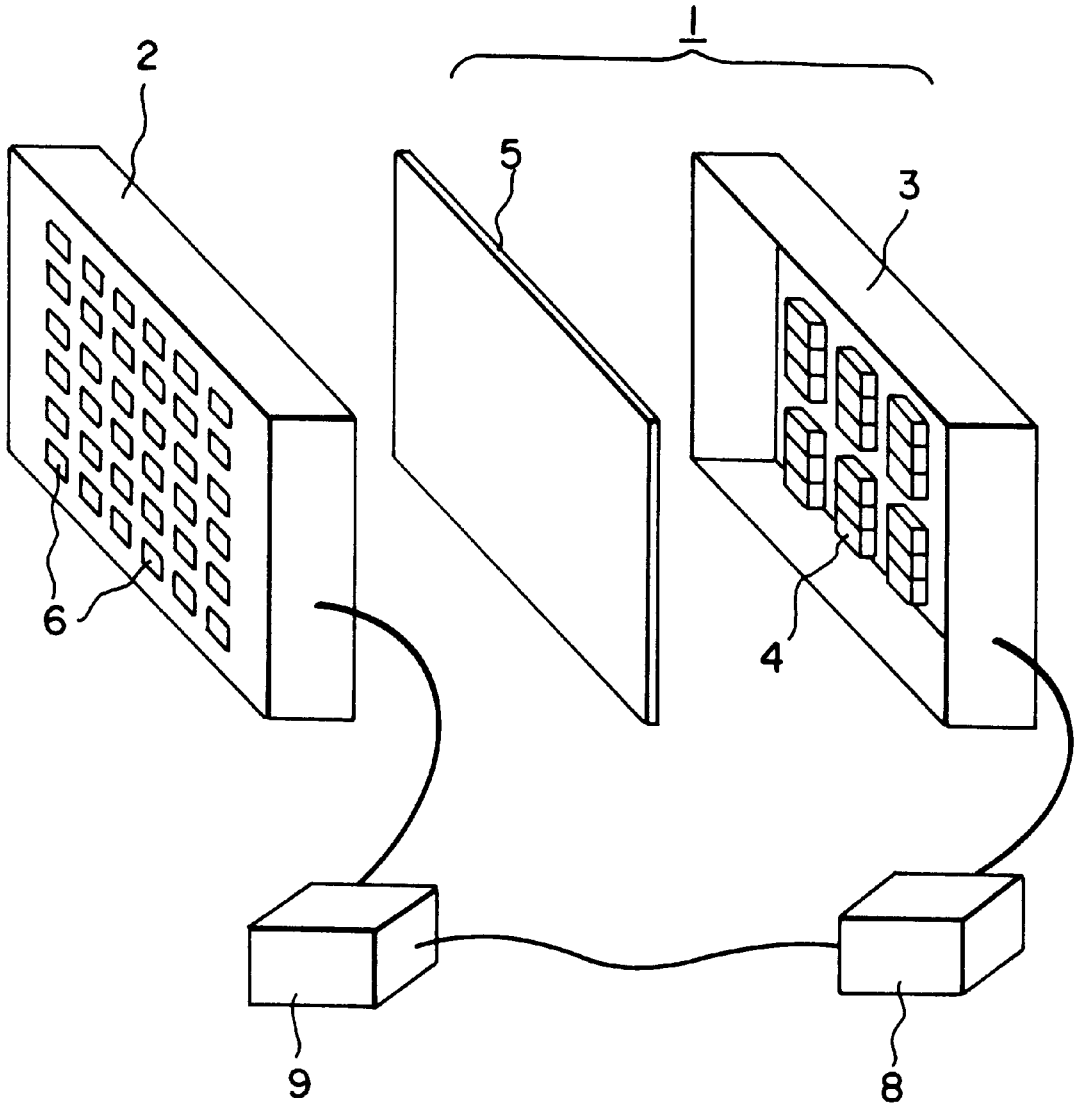
FIG. 1 and FIG. 2 are a perspective view and a block diagram showing the construction of a field-sequential type color display system according to a preferred embodiment of the invention.

The construction of the field-sequential type color display system which is driven according to this embodiment is the same as that of the embodiment as described hereinbefore and shown in FIGS. 1 and 2.

The constructions of the sub-fields according to this embodiment comprise, similar to those of the embodiment as described hereinbefore shown in FIG. 4, two fields, f1 and f2 for driving the liquid crystal shutter unit 2 by AC power and respective fields consist of three sub-fields, fR, fG, and fB.

Parts which are the same in this embodiment are denoted by the corresponding reference numerals same as those used in the embodiment described hereinbefore, and the detailed explanation thereof is omitted.

FIG. 6 shows in the order presented from the top thereof, common signals Cs1 to Cs3, a data signal Dr applied to one of the data electrodes 10, corresponding to the picture element 14 for displaying red as shown in FIG. 2, a differential signal Cs1−Dr, representing a difference between the common signal Cs1 and the data signal Dr, that is, a signal actually applied to the picture element 14, the optical response characteristic Tr of the picture element 14 for displaying red, and the light source driving signals Lr, Lg and Lb.

The common signals Cs1 to Cs3 will be at three different voltages, that is, a select voltage c1, unselect voltage Vm, and select voltage c2, which is equivalent to the select voltage c1 in absolute value, but at a polarity opposite to that of the select voltage c1. The data signal will be at an ON voltage d2 and an OFF voltage d1 with the common signals at c1, and will be at a reversed ON voltage d1 and OFF voltage d2 with the common signals at c2. Further, for resetting to white, the data signal will have the unselect voltage Vm as a third voltage level.

The span of the sub-field fB consists of a white reset period tw and four scanning frames fB1 to fB4 for resetting to white and scanning the common electrodes four times within the sub-field fB. Since the span of each sub-field is set to 6 ms in this embodiment, the white reset period tw becomes 2 ms and each of the scanning frames 1 ms.

When the common signals during the white reset period tw set all the common electrodes 11 shown in FIG. 2 to Vm at the same timing, and simultaneously, all the data electrodes 10 are turned to Vm, voltages applied to all picture elements are turned to 0V as indicated by the differential signal Cs1−Dr. As the white reset period tw is set to 2 ms in this embodiment, longer than the OFF response time of the liquid crystal shutter unit 2, all the picture elements in the display can be reset to white representing transmittivity at 100%.

By suspending output of the light source driving signals Lr, Lg, and Lb during the white reset period tw, degradation in chroma of the color in display does not occur.

The respective scanning frames consist of a select period ts for applying the select voltage c1 or the select voltage c2 of the common signals and an unselect period tns for applying the unselect voltage Vm, and the polarity of the select voltage is reversed from one scanning frame to another such as at c1 in fB1, at c2 in fB2, and so on. Further, polarities of voltages in the field f2 are opposite to those in the field f1 such as the select voltage at c2 in fR1, the select voltage at c1 in fR2, and so on.

In this embodiment, the polarities in the field f1 are reversed from those in the field f2. However, there will arise no problem without phase inversion in the field f2 since AC power has already been applied to the field f1. Further, even if all the select voltages of the field f1 are set at c1 and all the select voltages of the field f2 are set at c2, no problem arises whatsoever.

A common voltage Vc which is a voltage applied by the common signal Cs1 is defined as Vc=c1−Vm=Vm−c2, and a data voltage Vd which is a voltage applied by the data signal is defined as Vd=d1−Vm=Vm−d2. In this embodiment, the common voltage Vc is set to twice the value of the data voltage Vd. That is, the so-called bias ratio (Vc+Vd)/Vd=3.

Accordingly, if the data signal at the on voltage d2 is applied during the select period ts when the select voltage c1 is applied to the common electrodes 11, a voltage Vc+Vd=3×Vd is applied to the picture element while a voltage Vc−Vd=Vd is applied to the picture element when the data signal at the OFF voltage d1 is applied. During the unselect period tns when the unselect voltage Vm is applied to the common electrodes 11, the voltage Vd is applied to the picture element since the data voltage is either Vd or −Vd.

In this embodiment, when Vc+Vd=9V, the field-sequential color display system could be driven at a bias ratio in the range of 2 to 5, and when the bias ratio was at 3, the OFF voltage during the select period ts became the same as the voltage during the unselect period tns, Vd=3V, eliminating variation in transmittivity, as the differential signal Cs1−Dr in the sub-fields fR of fields f2 shows, and further, as this takes place after transmittivity returns to 100% during the white reset period tw, any degradation in transmittivity can be held to a minimal level, enabling average transmittivity throughout the scanning frames fR1 to fR4 to reach about 90% so that excellent white characteristics were achieved.

The picture element 14 needs to be in black display for the span of the sub-fields fB of the field 1. During the select period ts of the scanning frame fB1, an ON voltage, −Von=3×Vd=9V is applied as the differential voltage Cs1−Dr, and hence the response time becomes as fast as not more than 1 ms, turning the display to black for nearly 0% transmittivity. However, during the unselect period tns, the differential signal Cs1−Dr is reduced to −Vd, causing transmittivity to gradually revert to a higher level.

However, the select period ts of the scanning frame fB2 arrives immediately after, and a voltage Von as the differential signal Cs1−Dr is applied thereto, turning display to black again for a transmittivity as low as 0%. At this point in time, average transmittivity throughout the scanning frames fB1 to fB4 of the sub-field fB becomes about 8%, enabling the liquid crystal shutter to have a contrast ratio of about 11 and to display excellent color of enhanced chroma.

If the number of times that the respective sub-fields are scanned is excessive, the select period ts for applying the ON voltage Von becomes too short, and display in full black cannot be attained. Hence, the number of scanning times is preferably on the order of from 4 to 20. In particular, the best results were obtained at the number of scanning times of from 6 to 15.

As described hereinbefore with reference to the embodiments of the invention, even in the case where the STN liquid crystal panel is adopted for the liquid crystal shutter unit, it has become possible to provide a low-cost color display system capable of displaying arbitrary characters and graphics with excellent color, wherein multiplexing driving is realized by use of a plurality of common electrodes, enabling dot display by increasing the number of display segments, and furthermore, the contrast ratio of the liquid crystal shutter unit has been improved by providing a white reset period.

In the case of this embodiment, and as in the case of the embodiment described in the foregoing, it is intended to embrace all modifications and variations thereof that fall within the spirit and broad scope of the appended claims.

What is claimed is:

1. A color display system of a field-sequential type comprising:

a light source unit composed of a plurality of color light sources which emit light rays of different wavelengths, respectively, which can be controlled independently of one another;

a light source driving circuit for driving the light source unit;

a shutter unit for controlling transmittivity of light rays emitted by the light source unit; and a shutter control circuit for controlling the shutter unit in synchronization with the light source driving circuit, wherein a visual field is composed of a plurality of sub-fields corresponding to the plurality of color light sources of the light source unit, and multicolor display is effected by lighting the color light sources for specific colors, respectively, for each of the sub-fields, and by controlling the shutter unit according to the sub-field, wherein:

the shutter unit comprises a plurality of common electrodes; and said shutter control circuit having means for causing a plurality of picture elements to be selectively placed in a display state through multiplexing driving of the common electrodes in response to lighting of the specific color light sources, and means for keeping the shutter unit in a "closed" state by scanning each of the plurality of common electrodes within the sub-fields a plurality of times, wherein the shutter control circuit having means for keeping the shutter unit in "open" state providing a white reset period additionally within the subfields, respectively.

2. The color display system according to claim 1, wherein the shutter unit is a STN liquid crystal panel composed of twisted angle through 180 to 270°, the product Δnd of a birefringence Δn of the liquid crystals and a cell gap d being in the range of 650 to 850 nm.

3. The color display system according to claim 1, wherein the shutter unit is a STN liquid crystal panel composed of twisted angle through 180 to 270°, the product Δnd of a birefringence Δn of the liquid crystals and a cell gap d being in the range of 650 to 850 nm.

4. A method of driving a color display system of a field-sequential type comprising a light source unit composed of a plurality of color light sources which emit light rays of different wavelengths, respectively, and which can be controlled independently of one another, a light source driving circuit for driving the light source unit, a shutter unit provided with a plurality of common electrodes for controlling transmittivity of light rays emitted by the light source unit, and a shutter control circuit for controlling the shutter unit in synchronization with the light source driving circuit, wherein a visual field is composed of a plurality of sub-fields corresponding to the plurality of color light sources of the light source unit, and multicolor display is effected by lighting the color light sources for specific colors, respectively, for each of the sub-fields, and by controlling the shutter unit according to the sub-field, the method comprising steps of:

causing a plurality of picture elements to be selectively placed in a display state through multiplexing driving of the plurality of common electrodes provided in the shutter unit by the shutter control circuit in response to lighting of the color light sources of the light source unit for specific colors by the light source driving circuit; and scanning each of the plurality of common electrodes within the sub-fields a plurality of times for keeping the shutter unit in the "closed" state, wherein the shutter control circuit having means for keeping the shutter unit in "open" state providing a white reset period additionally within the subfields respectively.

5. The method of driving a color display system according to claim 4, further comprising a step of providing a time period for resetting to white in the respective sub-fields for keeping the shutter unit in the "open" state.

6. The method of driving a color display system according to claim 5, wherein for causing the plurality of picture elements to be selectively placed in a display state through multiplexing driving of the plurality of common electrodes provided in the shutter unit, common signals are applied to the common electrodes while data signals are applied to data electrodes crossing at right angles with the common electrodes, a ratio of a voltage applied by the common signals to that applied by the data signals being set to about 2:1.

7. The method of driving a color display system according to claim 6, wherein the span of the respective sub-fields is set to 4 to 6 ms, and each of the plurality of common electrodes are scanned from 6 to 15 times in the respective sub-fields for keeping the shutter unit in the "closed" state.

8. The method of driving a color display system according to claim 5, wherein the span of the respective sub-fields is set to 4 to 6 ms, and each of the plurality of common electrodes are scanned from 6 to 15 times in the respective sub-fields for keeping the shutter unit in the "closed" state.

9. The method of driving a color display system according to claim 4, wherein for causing plurality of picture elements to be selectively placed in a display state through multiplexing driving of the plurality of common electrodes provided in the shutter unit, common signals are applied to the common electrodes while data signals are applied to data electrodes crossing at right angles with the common electrodes, a ratio of a voltage applied by the common signals to that applied by the data signals being set to about 2:1.

10. The method of driving a color display system according to claim 9, wherein the span of respective sub-fields is set to 4 to 6 ms, and each of the plurality of common electrodes are scanned from 6 to 15 times in the respective sub-fields for keeping the shutter unit in the "closed" state.

11. The method of driving a color display system according to claim 4, wherein the span of the respective sub-fields is set to 4 to 6 ms, and each of the plurality of common electrodes are scanned from 6 to 15 times in the respective sub-fields for keeping the shutter unit in the "closed" state.

* * * * *